US008739866B2

(12) United States Patent
Huber et al.

(10) Patent No.: US 8,739,866 B2
(45) Date of Patent: Jun. 3, 2014

(54) METHOD FOR EXTRACTING BITUMEN AND/OR ULTRA-HEAVY OIL FROM AN UNDERGROUND DEPOSIT, ASSOCIATED INSTALLATION AND OPERATING METHOD FOR SAID INSTALLATION

(75) Inventors: Norbert Huber, Erlangen (DE); Bernd Wacker, Herzogenaurach (DE)

(73) Assignee: Siemens Aktiengesellschaft, München (DE)

( * ) Notice: Subject to any disclaimer, the term of this patent is extended or adjusted under 35 U.S.C. 154(b) by 605 days.

(21) Appl. No.: 13/063,500

(22) PCT Filed: Aug. 5, 2009

(86) PCT No.: PCT/EP2009/060132
§ 371 (c)(1),
(2), (4) Date: Jun. 3, 2011

(87) PCT Pub. No.: WO2010/028917
PCT Pub. Date: Mar. 18, 2010

(65) Prior Publication Data

US 2011/0227349 A1 Sep. 22, 2011

(30) Foreign Application Priority Data

Sep. 15, 2008 (DE) ..... 10 2008 047 219

(51) Int. Cl.
*E21B 43/24* (2006.01)

(52) U.S. Cl.
USPC ..... 166/248; 166/57; 166/75.11; 166/75.12; 166/272.1; 166/272.3; 166/272.7; 166/302; 166/303

(58) Field of Classification Search
None
See application file for complete search history.

(56) References Cited

U.S. PATENT DOCUMENTS

| | | | | |
|---|---|---|---|---|
| 3,848,671 | A | 11/1974 | Kern | |
| 4,037,655 | A * | 7/1977 | Carpenter | 166/248 |
| 4,160,479 | A * | 7/1979 | Richardson et al. | 166/267 |
| 4,679,626 | A | 7/1987 | Perkins | |
| 6,357,526 | B1 | 3/2002 | Abdel-Halim | |
| 8,176,982 | B2 * | 5/2012 | Gil et al. | 166/272.1 |

(Continued)

FOREIGN PATENT DOCUMENTS

| | | |
|---|---|---|
| DE | 1008861 B | 5/1957 |
| DE | 2636590 A1 | 2/1978 |

(Continued)

OTHER PUBLICATIONS

Canada's Oil Sands and Heavy Oil; Apr. 2000; pp. 1-44; http://www.centreforenergy.com/documents/187.pdf.

*Primary Examiner* — George Suchfield

(57) ABSTRACT

A method for extracting bitumen and/or extra-heavy oil from an underground deposit is provided. The energy for producing the steam and for the electric heating is generated in situ, for which purpose part of the extracted bitumen and/or extra-heavy oil is burned in an industrial turbine with a downstream generator coupled to the turbine. The industrial turbine may be a gas turbine or a steam turbine. In particular the industrial turbine with downstream generator is assigned a waste heat recovery steam generator which serves for generating the steam and accordingly takes the form of a boiler. Through intermediate storage of the bitumen and/or ultra-heavy oil produced it is possible to implement a self-contained closed circuit which operates autonomously, independently of any external energy supply, using approx. 20% of the extracted bitumen and/or extra-heavy oil for the purposes of extraction.

20 Claims, 2 Drawing Sheets

(56) References Cited

U.S. PATENT DOCUMENTS

| | | | | |
|---|---|---|---|---|
| 2007/0095536 | A1* | 5/2007 | Vinegar et al. | 166/302 |
| 2007/0261844 | A1* | 11/2007 | Cogliandro et al. | 166/248 |
| 2009/0020456 | A1* | 1/2009 | Tsangaris et al. | 208/133 |
| 2009/0194280 | A1* | 8/2009 | Gil et al. | 166/267 |

FOREIGN PATENT DOCUMENTS

| | | | |
|---|---|---|---|
| DE | 4238247 | A1 | 5/1993 |
| DE | 60115873 | T2 | 8/2006 |
| DE | 102006005277 | A1 | 11/2006 |
| DE | 102007008292 | A1 | 8/2008 |
| DE | 102007040605 | B3 | 10/2008 |
| DE | 102007040607 | B3 | 10/2008 |
| DE | 102007036832 | A1 | 2/2009 |
| EA | 12931 | B1 | 2/2010 |
| RU | 2060378 | C1 | 5/1996 |
| WO | WO 2005045192 | A1 | 5/2005 |
| WO | WO 2005091883 | A2 | 10/2005 |
| WO | WO 2006115943 | A1 | 11/2006 |
| WO | WO 2008049201 | A1 | 5/2008 |
| WO | WO 2008098850 | A1 | 8/2008 |

* cited by examiner

METHOD FOR EXTRACTING BITUMEN AND/OR ULTRA-HEAVY OIL FROM AN UNDERGROUND DEPOSIT, ASSOCIATED INSTALLATION AND OPERATING METHOD FOR SAID INSTALLATION

CROSS REFERENCE TO RELATED APPLICATIONS

This application is the US National Stage of International Application No. PCT/EP2009/060132, filed Aug. 5, 2009 and claims the benefit thereof. The International Application claims the benefits of German application No. 10 2008 047 219.0 DE filed Sep. 15, 2008. All of the applications are incorporated by reference herein in their entirety.

FIELD OF INVENTION

The invention relates to a method for extracting bitumen and/or extra-heavy oil from an underground deposit, wherein the viscosity of the bitumen and/or extra-heavy oil is reduced in situ, for which purpose the deposit is supplied with energy in the form of steam flowing through the deposit on the one hand and electric heating on the other hand. In addition the invention also relates to the associated installation and to a method for operating said installation.

BACKGROUND OF INVENTION

With the "in situ" method of extracting bitumen from oil sands using steam (e.g. Cyclic Steam Stimulation=CSS; Steam Assisted Gravity Drainage=SAGD), large quantities of water vapor are required for heating the bitumen in the deposit. Typically, steam at a temperature of 250° C. and having a quality of 0.95, i.e. in the almost superheated state, is used. Although this steam has a very high energy content, very large volumes of water accumulate and have to be pumped to the earth's surface again together with the oil and recovered there.

The use of additional electric heating of a reservoir is already described in DE 10 2007 008 292 A1 as well as in the earlier non-prior-published German patent applications of the applicant DE 10 2007 036 832, DE 10 2007 040 605 and DE 10 2007 040 607 and can be successfully demonstrated by means of mathematical simulations. Specifically in the case of the additional inductive heating proposed there, reference is made to the EM(Electromagnetic)-SAGD method.

However, the relatively high cost of electric power compared with the energy form "steam" reduces the economic advantage of the latter proposals.

Extraction of bitumen from oil sands with the assistance of electric heating-has not yet been employed commercially in a real-world application. In known pilot installations which employ purely electric, resistive heating the electric power is taken from the electricity grid.

The steam for SAGD or CSS methods is mostly generated in separate steam boilers which are typically fired by natural gas or bitumen. It has also been proposed to extract process steam for the above purpose from existing gas and steam installations whose electrical energy is fed into the power grid. These installations are therefore always arranged centrally and at a fixed location, and the transmission of the energy is associated with not insignificant losses.

Proceeding on this basis, it is an object of the invention to propose a method concept by means of which the cost-effectiveness of the already proposed method can be improved.

Another object is to disclose an associated installation with corresponding operating method.

SUMMARY OF INVENTION

The object is achieved according to the invention by means of a method as claimed in the claims. An associated installation is disclosed in the claims. Its advantageous operating method is the subject of the method claim. Developments of the method, the installation and the associated operating method are the subject matter of the dependent claims.

The subject matter of the invention is a process engineering concept for extracting bitumen or extra-heavy oil from oil sands which is characterized by an autonomous energy supply and by an extraction process that is particularly favorable in terms of economic efficiency. The operating resources required for this are provided by means of the installation according to the invention.

What is proposed with the invention is an operating concept for bitumen or extra-heavy oil production from in particular oil sand deposits, wherein an industrial turbine is used which is combined with a generator and a waste heat recovery boiler or a separately fired boiler. The industrial turbine can be either a gas turbine or alternatively a steam turbine.

According to the invention either a waste heat recovery boiler or a fired boiler can be used with the optional use of the gas turbine or steam turbine. The waste heat produced during the generation of the electric power is introduced into the waste heat recovery boiler. The waste heat recovery boiler is supplied by a valve unit with process water which is evaporated by the waste heat from the gas turbine. The steam thus generated is supplied to the collector unit. With a separately fired boiler, in contrast, the steam can equally be generated from externally supplied water both for the SAGD method and for the generation of electric power by way of the steam turbine.

Within the scope of the invention a gas turbine and a steam turbine can also be combined with each other if necessary. In such an arrangement the waste heat produced during the generation of the electric power is recycled in the gas turbine. Steam can also be generated according to the boiler principle in the fired boiler if the used exhaust gas from the gas turbine is not sufficient for the steam generation by the waste heat recovery boiler. The steam turbine is operated with the excess steam accumulating in the process.

In both alternatives, part of the extracted bitumen, preferably approx. 20%, is burned. As a result electric power and steam can be generated simultaneously in the ratio of, for example, approx. 1:4 in terms of power. Such an apportionment of power corresponds to a favorable ratio in previously performed reservoir simulations for electromagnetic heating combined with steam injection (EM-SAGD).

A particularly advantageous aspect of the invention is the self-contained, autonomous closed circuit during the operation of the EM-SAGD installation. In a first alternative this is realized in particular as a result of the fact that the gas turbine, which must be suitable for burning bitumen or extra-heavy oil, is fired directly by the fuel which comes from the bitumen production of the oil sand deposit that is to be exploited. In this case the exhaust gas from the gas turbine can be thermally supplied to a waste heat recovery boiler with steam generator which generates steam having a temperature of e.g. approx. up to 300° C. The feedwater system of the waste heat steam generator can be provided with a feedwater pump so that the reservoir-specific pressure can be regulated. The reservoir where the steam is injected via the so-called "injector well" serves as a condenser. The steam heats the reservoir and makes it more permeable. In the second alternative with the steam turbine, in contrast, steam is generated by means of a separately fired boiler in which fuel from the bitumen production is burned. The steam coming from said boiler can be output to the steam line of the injector pipelines on the one hand and on the other hand can be used to drive the steam turbine.

In both cases the gas turbine or steam turbine is mechanically coupled to a generator which generates electric power in the known manner, but which is now used exclusively for the specific requirements of bitumen or extra-heavy oil production. The electric power thus generated is distributed via transformers and switching stations of a so-called "well pad" in such a way as to supply the individual electrical modules for the EM-SAGD power supply. The EM-SAGD modules supply in particular inductors which are arranged as special lines in the ground of the reservoir and via which the ground is additionally heated as a result of alternating-current losses, resulting in an optimization of the bitumen production.

By means of the invention it is possible to improve to a substantial degree the bitumen production of an existing SAGD installation having so-called "well pairs" in which a pair consists of a steam injection pipeline ("injector well") and an associated drainage bitumen production pipeline ("producer well") or "extractor pipe" for short. The bitumen-water mixture is conveyed via the producer well, which lies horizontally under the inductor.

The ratio between electrical energy applied to the inductor and the energy introduced thereby into the reservoir and the steam is equal to the ratio of the energy generated from the turbine generator and the waste heat recovery boiler which is disposed downstream of the gas turbine. This applies analogously to the separately firable steam boiler of the steam turbine. In both cases the ratio typically equals 1:3. The power for a well pair can in this case be around 1 MW of electric heating power and between 3 and 4 MW of steam power.

In the method according to the invention the extracted bitumen-water mixture is cleaned in a treatment plant and the water removed. The extracted water is supplied to the feedwater system in a boiler-friendly form. The bitumen is transported or, as the case may be, treated so as to be suitable for a refinery, i.e. dried and cleaned. Undiluted bitumen is branched off for burning in the industrial gas turbine or in the fired steam boiler. For this purpose it is necessary to heat the bitumen to approx. 110° C. in order to convert it to a sufficiently low viscosity.

Specifically when using a gas turbine it is in fact necessary for starting up from the cold-start state to use conventional light fuel oil temporarily. After an adequate combustion chamber temperature has been reached and after the bitumen has been heated, which can be effected from a sub-flow of the steam from the waste heat recovery boiler, the fuel supply system ("fuel skid") of the gas turbine can be converted to bitumen combustion. If the turbine is to be shut down, the system must first be switched back to fuel oil operation so that all of the bitumen will be purged from the feed lines to the burners.

BRIEF DESCRIPTION OF THE DRAWINGS

Further details and advantages of the invention will emerge from the following description of exemplary embodiments with reference to the figures of the drawing in conjunction with the claims.

In the figures, like units have like reference numerals. FIG. 2 and FIG. 3 are described together to the extent that the differences between them are made clear.

DETAILED DESCRIPTION OF INVENTION

Figure 1:
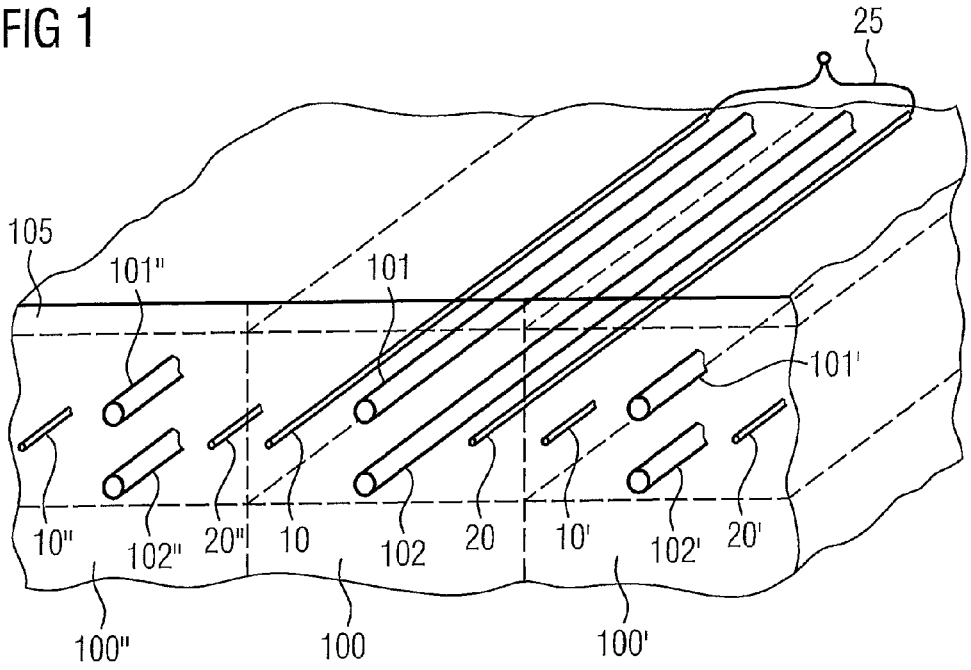
FIG. 1 shows a perspective view of part of an oil sand deposit which has means for the known SAGD method and into which further means for inductive heating of the reservoir are introduced.

FIG. 1 shows part of an oil sand deposit which can be located several hundred meters underground.

In accordance with the prior art described in the earlier, non-prior-published German patent application DE 10 2007 040 605, FIG. 1 contains in a unit cell 100 of a reservoir a steam injector having an injector well 101 and a producer well 102 for bitumen/extra-heavy oil production with simultaneous water recovery. In particular for inductive heating, separate lines 10, 20 are present as inductors which are closed either underground or on the surface by way of a loop 25. Further cells 100', 100" . . . of the reservoir are configured similarly.

Figure 2:
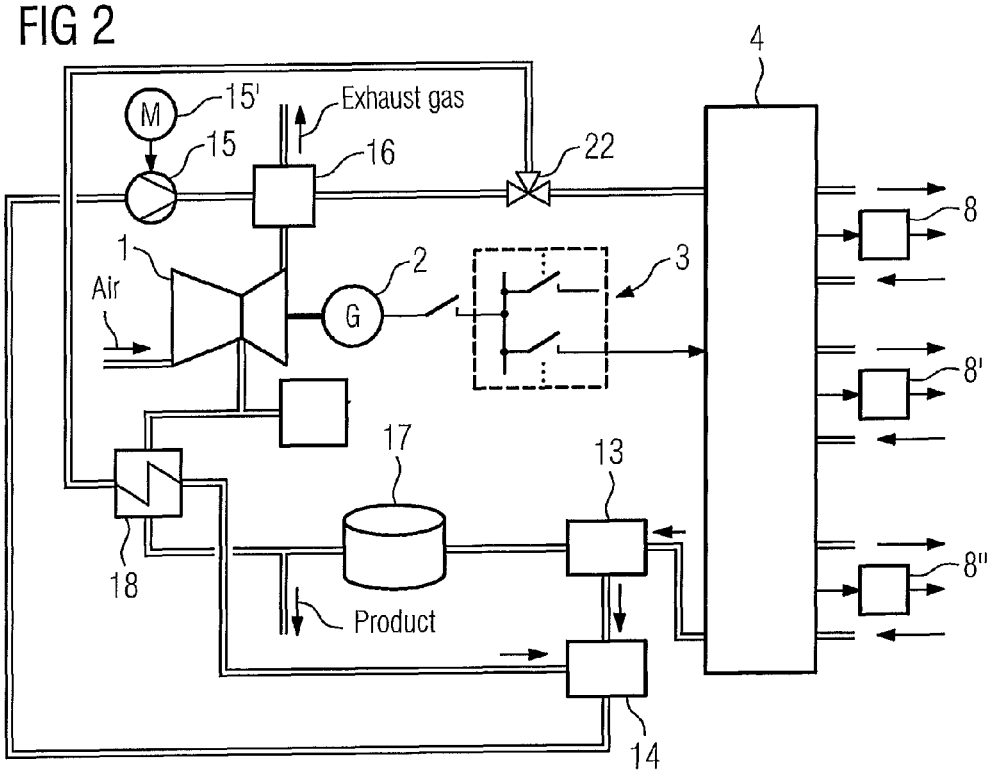
FIG. 2 shows a first embodiment variant of the technical means of the installation for generating electric power on the one hand and steam on the other.
Figure 3:
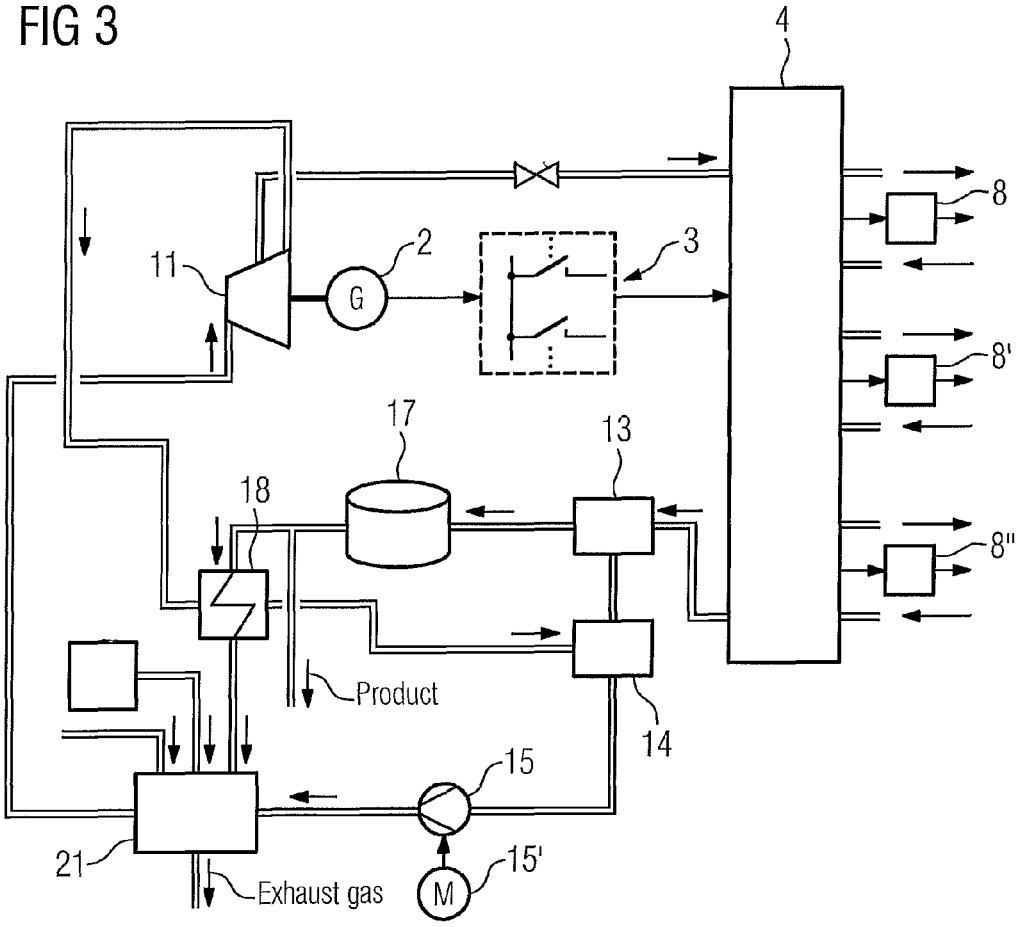
FIG. 3 shows a second embodiment variant of the technical means of the installation for generating electric power on the one hand and steam on the other.

The different operating means for implementing a combined EM-SAGD method with inductive heating are elucidated with reference to FIGS. 2 and 3: Although the illustrated embodiments herein show inductive heating, resistive heating may be provided in addition to or alternately to inductive heating.

FIG. 2 shows a gas turbine with a compressor labeled with reference numeral 1. The gas turbine 1 can be a conventional industrial turbine which can be fired by means of different fuels. An air inlet is present at the rear and a feed for a fuel is disposed at the side.

An electric generator 2 is connected downstream of the gas turbine 1, gas turbine 1 and generator 2 being mechanically coupled. A switching station or electric distributor unit 3 is controlled by the generator 2 for the purpose of distributing power. A general distributor and collector unit 4 for distributing steam and current on the one hand and for collecting the product on the other hand is controlled by the electric power distribution unit 3. Among technical experts such a facility 4 is generally referred to as a "well pad".

The individual "well pairs" contained in the cells 100, 100', 100", . . . from FIG. 1, each consisting of a pipeline pair with injector well 101, are controlled by the distributor unit 4. The energy in the form of steam on the one hand and in the form of electric power on the other hand is distributed.

For this purpose the well pad 4 contains a steam collector line (not shown in detail), an electric switching station and a receptacle device for the extracted product. Accordingly, means for controlling the material flow in the extraction of the bitumen and/or extra-heavy oil including the recovered water are implemented. Reference numerals 8, 8', 8" . . . represent inverters for the alternating-current supply which is fed by the switching station.

Also present in the supply unit with the operating means is a device for separating the extracted bitumen/extra-heavy oil from the recovered water, said device being labeled with reference numeral 13. A unit for treating and recycling the recovered water can likewise be integrated therein, a unit 14 for supplying and removing the water also being present. The treated water can then likewise be used for steam generation and is supplied by means of a pump 15 with motor 15' to the waste heat recovery boiler 16 for the purpose of generating steam. The steam thus generated is ducted by way of a valve arrangement 22 into the distributor unit 4. The electric power and the steam are routed via internal distributor buses to the corresponding outputs of the distributor unit 4.

Reference numeral 17 in FIG. 2 designates a storage facility for the extracted bitumen and/or extra-heavy oil, branching out from which is in particular an outgoing line for the extracted product for upgrading and refining purposes. A small part of the extracted bitumen and/or extra-heavy oil is routed via a heat exchanger unit 18 which has an outlet for the purpose of heating the gas turbine 1.

Alternative or supplementary operating means to FIG. 2 for implementing a combined SAGD method and electric heating, in particular inductive heating, are elucidated with reference to FIG. 3:

FIG. 3 shows a steam turbine labeled with reference numeral 11. The steam turbine 11 is a specific industrial turbine which can be driven exclusively by means of steam. An electric generator 2 is connected downstream of the steam turbine 11, steam turbine 11 and generator 2 being mechanically coupled. The unit 3 for electric power distribution and a general distributor and collector unit 4 for distributing steam and electricity on the one hand and for collecting the product on the other hand, already referred to above as a "well pad", are in turn controlled by the generator 2. This is how the consolidation of a plurality of wells into a single technical entity is defined in English technical terminology (well=borehole, pad=block, field).

The individual "well pairs", each consisting of a pipeline pair via which energy is distributed in the form of steam on the one hand and in the form of electric power on the other hand, are controlled by the distributor unit 4.

For this purpose the well pad 4 contains a steam collector line (not shown in detail), an electric switching station and a receptacle device for the extracted product. Accordingly, means for controlling the material flow during the extraction of the bitumen and/or extra-heavy oil including water are implemented. Reference numeral 8 represents an operating unit for the power supply which is fed by the switching station.

Also present in the supply unit with the operating means is a device for separating the extracted bitumen/extra-heavy oil from the water that is to be recovered, said device being labeled with reference numeral 13. A unit for treating and recycling the water is likewise integrated therein, the feedwater system being labeled with reference numeral 14.

Reference numeral 17 in FIG. 2 and FIG. 3 designates a storage facility or repository for the extracted bitumen and/or extra-heavy oil, branching out from which is in particular an outgoing line for treatment and refining purposes. A specific part of the extracted bitumen and/or extra-heavy oil is routed via a unit 18 and serves for generating steam in the boiler 21, i.e. in equal measure steam for the SAGD method and steam for generating electric power in the steam turbine for the purpose of inductive heating of the deposit.

The two method concepts are therefore different specifically in the embodiment of the industrial turbine: A gas turbine can be operated with different fuels, the steam for the SAGD method being generated by means of the accumulating waste heat. A steam turbine, in contrast, can only be operated with steam which is first generated in a boiler by electric heating of water.

Taken as a basis in a specific exemplary embodiment is an installation comprising 50 well pairs for producing approx. 50,000 barrels of bitumen per day. Three gas turbines each delivering 17 MW of electric power are used. Each well pair requires 1 MW of electrical energy and 3 . . . 4 MW of steam. The electricity required for operating the installation itself and steam are branched off. If one of the gas turbines fails, the power consumption for bitumen production is reduced in a controlled manner and accordingly the quantity of steam to be distributed is likewise distributed.

Overall, the energy required for the extraction is generated in both exemplary embodiments by burning extracted bitumen or extra-heavy oil in an autonomous, self-contained circuit. For combustion purposes the bitumen or a bitumen mixture consisting of bitumen/light oil or bitumen/solvent is used, naphtha being used as the solvent. If a gas turbine is used as the industrial turbine, a fuel treatment taking place upstream of the combustion chambers of the gas turbine can ensure that by heating the fuel up to 150° C. an adequate viscosity is achieved and the injection into the combustion chambers can take place. Separators and filters can be used in the fuel treatment to recover heavy metals, ash and other particles. A distiller can also be connected upstream, its distillate being supplied to the fuel treatment of the industrial turbine, with the heavier polyaromatics, i.e. asphaltenes, being added to the produced bitumen which is transported as product to the refinery. Instead of a distiller a so-called "cracker" can be provided which degrades long-chain hydrocarbons until they are broken down into a form suitable for use as fuel.

In both of the installation schemes that have been described in detail it is crucial in each case to implement a self-contained, autonomous circuit for bitumen/extra-heavy oil extraction which requires no additional external electrical energy supply. This provides independence from existing electricity grids, which means that the entire installation is mobile and can be deployed at alternate sites of operation of an oil sand or oil shale deposit with an existing SAGD extraction facility already being present in each case.

The invention claimed is:

1. A method for extracting bitumen and/or extra-heavy oil from an underground deposit, comprising:

lowering the viscosity of the bitumen and/or extra-heavy oil "in situ", by supplying energy to the deposit in a form of steam flowing through the deposit and electric power for inductive and/or resistive heating;

generating in a decentralized manner the energy for generating the steam and also for electric heating at a site of the extraction facilities; and using part of the extracted bitumen and/or extra-heavy oil for operating an industrial turbine having a generator coupled thereto for the purpose of generating electric power, wherein the electric generator supplies the power required for electric heating purposes and a boiler associated with the industrial turbine is used for generating steam by evaporation of water that is separated and recovered from the extracted bitumen and/or extra-heavy oil, wherein the method further comprises providing at least one well pad for distributing said steam and said electrical power, to which the electric power generated in the generator and power in the form of steam are simultaneously supplied in a ratio of between 1 to 3 and 1 to 4.

2. The method as claimed in claim 1, wherein approximately 20% of the extracted bitumen and/or extra-heavy oil is used for generating the electric power and the water vapor.

3. The method as claimed in claim 1, wherein the bitumen and/or extra-heavy oil are combusted and used in an autonomous closed circuit.

4. The method as claimed in claim 3, wherein bitumen or a bitumen mixture consisting of bitumen/light oil or bitumen/solvent is used for combustion.

5. The method as claimed in claim 1, wherein the industrial turbine is a gas turbine by means of which additional gaseous fuels may be combusted.

6. The method as claimed in claim 5, wherein a fuel treatment upstream of the combustion chambers of the gas turbine ensures that by heating the fuel up to 150° C. a viscosity of the fuel is achieved such as permits an injection of the fuel into the combustion chambers.

7. The method as claimed in claim 5, wherein separators and filters which recover heavy metals, ash and other particles are used for a fuel treatment.

8. The method as claimed in claim 7, wherein a distiller is connected upstream of the industrial turbine, a distillate being supplied to the fuel treatment of the industrial turbine, with the heavier polyaromatics being added to the produced bitumen which is transported as product to a refinery.

9. The method as claimed in claim 7, wherein a cracker is provided which degrades long-chain hydrocarbons down to a form suitable for use as fuel.

10. The method as claimed in claim 1, wherein a steam turbine which may be driven by the steam generated from the combustion of the bitumen/extra-heavy oil is used as the industrial turbine.

11. An installation for extracting bitumen and/or extra-heavy oil with simultaneous water recovery from an underground deposit which is heated in order to reduce the viscosity of the extra-heavy oil, comprising:

an industrial turbine including a downstream electric generator, wherein steam is introduced into and piped through the deposit on the one hand and for which purpose the deposit is electrically heated in addition, and wherein the industrial turbine is heated using the bitumen and/or extra-heavy oil which is extracted from the underground deposit, wherein the installation further comprises at least one well pad for distributing said steam and said electrical power, to which the electric power generated in the generator and power in the form of steam are simultaneously supplied in a ratio of between 1 to 3 and 1 to 4.

12. The installation as claimed in claim 11, wherein the industrial turbine is a gas turbine or a steam turbine.

13. The installation as claimed in claim 11, further comprising an above-ground intermediate storage facility for the extracted bitumen and/or extra-heavy oil.

14. The installation as claimed in claim 13, wherein a device for separating the water-bitumen/extra-heavy oil mixture and for treating the bitumen and/or extra-heavy oil is connected upstream of the intermediate storage facility.

15. The installation as claimed in claim 11, further comprising a switching station for controlling an electric heating device.

16. The installation as claimed in claim 15, wherein the electric heating device comprises an inductor which is routed as a closed electric loop in the deposit.

17. The installation as claimed in claim 15, wherein the industrial turbine is controlled as a function of heating requirements in that the heat necessary for heating the deposit is calculated in a control device and the fuel required for the industrial turbine including for electricity and steam generation is supplied.

18. The installation as claimed in claim 11, wherein the industrial turbine is assigned a waste heat recovery boiler as a heat accumulator whose stored heat is used to evaporate water.

19. The installation as claimed in claim 11, wherein the industrial turbine including the generator, a waste heat accumulator as well as supply units for steam generating devices and an inductor form an interconnected circuit.

20. The installation as claimed in claim 11, further comprising:

a separating device for separating and recovering water from the extracted bitumen and/or extra-heavy oil, and a boiler associated with the industrial turbine, wherein the electric generator supplies the power required for electric heating purposes and the boiler associated with the industrial turbine is used for generating steam by evaporation of the water recovered from the extracted bitumen and/or extra-heavy oil.

* * * * *